US008125395B2

(12) United States Patent
Yang et al.

(10) Patent No.: US 8,125,395 B2
(45) Date of Patent: Feb. 28, 2012

(54) MULTI-BAND ANTENNA

(75) Inventors: Wen-Chieh Yang, Taipei (TW); Kai Shih, Taipei (TW); Yu-Yuan Wu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 490 days.

(21) Appl. No.: 12/481,575

(22) Filed: Jun. 10, 2009

(65) Prior Publication Data

US 2010/0315308 A1 Dec. 16, 2010

(51) Int. Cl.
*H01Q 1/48* (2006.01)

(52) U.S. Cl. ..... 343/702; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 7,728,776 | B2 * | 6/2010 | Lin et al. | 343/702 |
| 7,994,988 | B2 * | 8/2011 | Wu et al. | 343/702 |
| 2005/0116865 | A1 * | 6/2005 | Fang et al. | 343/702 |
| 2010/0060525 | A1 * | 3/2010 | Yang et al. | 343/700 MS |

* cited by examiner

*Primary Examiner* — Jacob Y Choi
*Assistant Examiner* — Robert Karacsony

(57) ABSTRACT

A multi-band has as an elongated grounding plate disposed vertically with a top edge defined thereon. A simulation induction portion includes a first conduction strip extended obliquely from a substantial middle of the top edge and a second conduction strip extended along the top edge from a free end of the first conduction strip to form an obtuse angle between the first and second conduction strips. A connecting portion extends perpendicularly and opposite to the grounding plate from a free end of the second conduction strip. A feeding point disposes on the connecting portion, adjacent to the second conduction strip. A high frequency radiator and a low frequency radiator are extended opposite to each other from a free end of the connecting portion.

4 Claims, 5 Drawing Sheets

| | | | | |
|---|---|---|---|---|
| 1 | 824MHz | 92.295 Ω | -75.890 Ω | 2.545pF |
| 2 | 960MHz | 36.661 Ω | 47.554 Ω | 7.884nH |
| 3 | 1.71GHz | 49.336 Ω | 27.195 Ω | 2.531nH |
| 4 | 1.88GHz | 88.579 Ω | -6.602 Ω | 12.822pF |
| 5 | 2.17GHz | 38.577 Ω | 26.485 Ω | 1.943nH |

| | | |
|---|---|---|
| Mkr1 | 824MHz | 3.338 |
| Mkr2 | 960MHz | 2.922 |
| Mkr3 | 1.71GHz | 1.708 |
| Mkr4 | 1.88GHz | 1.768 |
| Mkr5 | 2.17GHz | 1.912 |

| | frequency (MHZ) | Efficiency(%) | Average Efficiency(%) |
|---|---|---|---|
| GSM850 | 824 | 40.73 | 57.97 |
| | 836 | 48.49 | |
| | 849 | 59.64 | |
| | 869 | 68.16 | |
| | 880 | 72.84 | |
| GSM900 | 881 | 72.93 | 70.71 |
| | 894 | 75.17 | |
| | 902 | 76.22 | |
| | 915 | 75.51 | |
| | 925 | 73.95 | |
| | 942 | 67.32 | |
| | 960 | 53.86 | |
| DCS | 1710 | 69.36 | 58.50 |
| | 1747 | 59.31 | |
| | 1785 | 55.81 | |
| | 1805 | 55.51 | |
| | 1842 | 54.88 | |
| | 1850 | 56.11 | |
| PCS | 1880 | 57.98 | 67.38 |
| | 1910 | 68.40 | |
| | 1930 | 72.60 | |
| | 1960 | 72.02 | |
| | 1990 | 65.91 | |
| WCDMA | 2110 | 50.26 | 44.91 |
| | 2140 | 43.58 | |
| | 2170 | 40.89 | |

FIG. 5

MULTI-BAND ANTENNA

BACKGROUND OF THE INVENTION

1. Field of the Invention

The invention relates to a multi-band antenna, and particularly to a multi-band antenna with a compact structure adapted for being mounted in a portable electronic device.

2. The Related Art

With the development of wireless communication, more and more portable electronic devices, such as a notebook, install an antenna for working in a Wireless Wide Network (WWAN), such as GSM850 (Global System for Mobile communications), GSM900 (Global System for Mobile communications), DCS (Digital Cellular System), PCS (Personal Conferencing Specification) and WCDMA (Wideband Code Division Multiple Access). However, a conventional antenna generally has a big size for meeting a requirement of multiple frequency bands which is against miniaturization trend of the portable electronic device. So it is necessary to design an antenna with a simple and compact structure capable of covering above-mentioned frequency bands synchronously.

SUMMARY OF THE INVENTION

An object of the present invention is to provide a multi-band antenna with a compact structure capable of being mounted in a portable electronic device.

The multi-band antenna has an elongated grounding plate disposed vertically with a top edge defined thereon. Two opposing ends of the top edge respectively extend perpendicularly to form a first fixing portion and a second fixing portion. A simulation induction portion includes a first conduction strip extended obliquely from a substantial middle of the top edge and located at a substantially same plane with the first fixing portion, a second conduction strip extended along the top edge and towards the second fixing portion from a free end of the first conduction strip to form an obtuse angle between the first and second conduction strips. A connecting portion extends opposite to the grounding plate and perpendicularly from a free end of the second conduction strip. A feeding point is disposed on the connecting portion adjacent to the second conduction strip. A high frequency radiator has a first radiation strip extended downwards and then towards the second fixing portion from a free end of the connecting portion, facing to the grounding plate, a second radiation strip extended towards the grounding plate from a top edge of a free end of the first radiation strip, a third radiation strip extended perpendicularly from a free end of the second radiation strip and opposite to the first radiation strip. A low frequency radiator includes a fourth radiation strip extended oppositely to the first radiation strip from an end of the first radiation strip, a fifth radiation strip located at a substantially same plane with the connecting portion, with an inner edge and an outer edge farther from the grounding plate than the inner edge thereof. Two opposite ends of the outer edge of the fifth radiation strip respectively are connected with a free end of the fourth radiation strip and an end of a sixth radiation strip. The sixth radiation strip extends from the fifth radiation strip opposite to and in alignment with the fourth radiation strip. A seventh radiation strip extends from a free end of the sixth radiation strip opposite to and in alignment with the fifth radiation strip.

As described above, the multi-band antenna has a simple and compact structure to suit miniaturization development of the portable electronic device and reduce a manufacture cost, meanwhile, can improve performances of the multi-band antenna in a high and low frequency bands, such as in GSM850 (824~880 MHZ), GSM900 (881~960 MHZ), DCS (1710~1850 MHZ), PCS (1880~1990 MHZ) and WCDMA (2110~2170 MHZ).

BRIEF DESCRIPTION OF THE DRAWINGS

The present invention will be apparent to those skilled in the art by reading the following description of an embodiment thereof, with reference to the attached drawings, in which:

FIG. 5 shows an Antenna Performance test chart of the multi-band antenna shown in FIG. 1.

DETAILED DESCRIPTION OF THE EMBODIMENT

Figure 1:
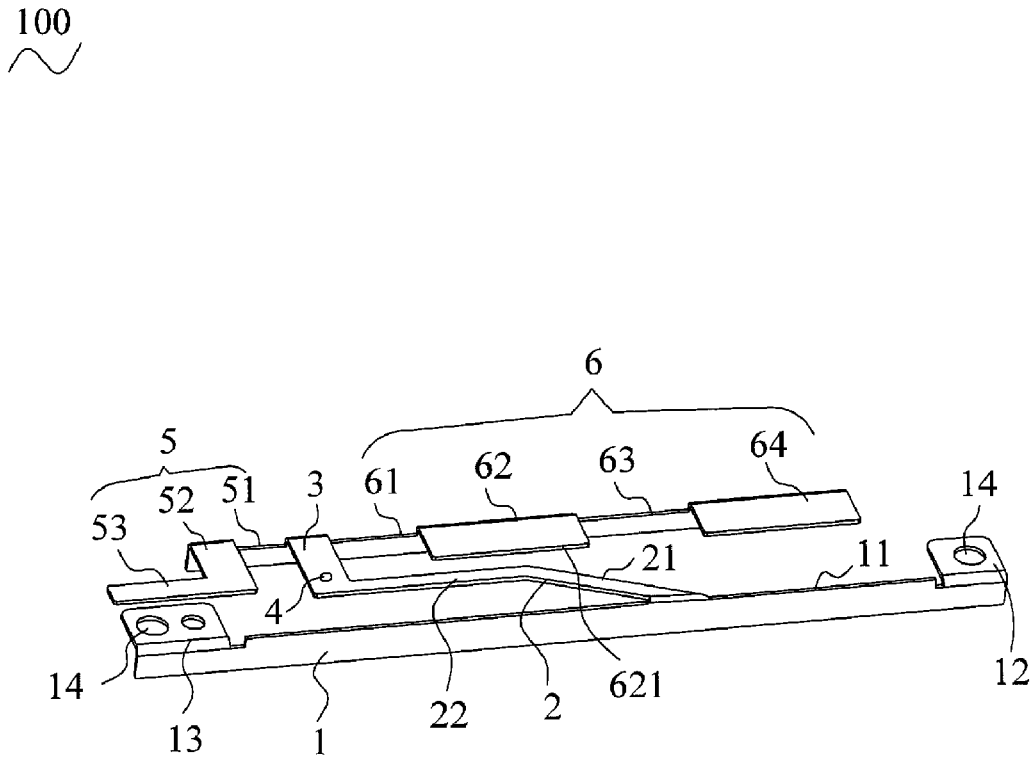
FIG. 1 is a perspective view of a multi-band antenna according to the present invention.
Figure 2:
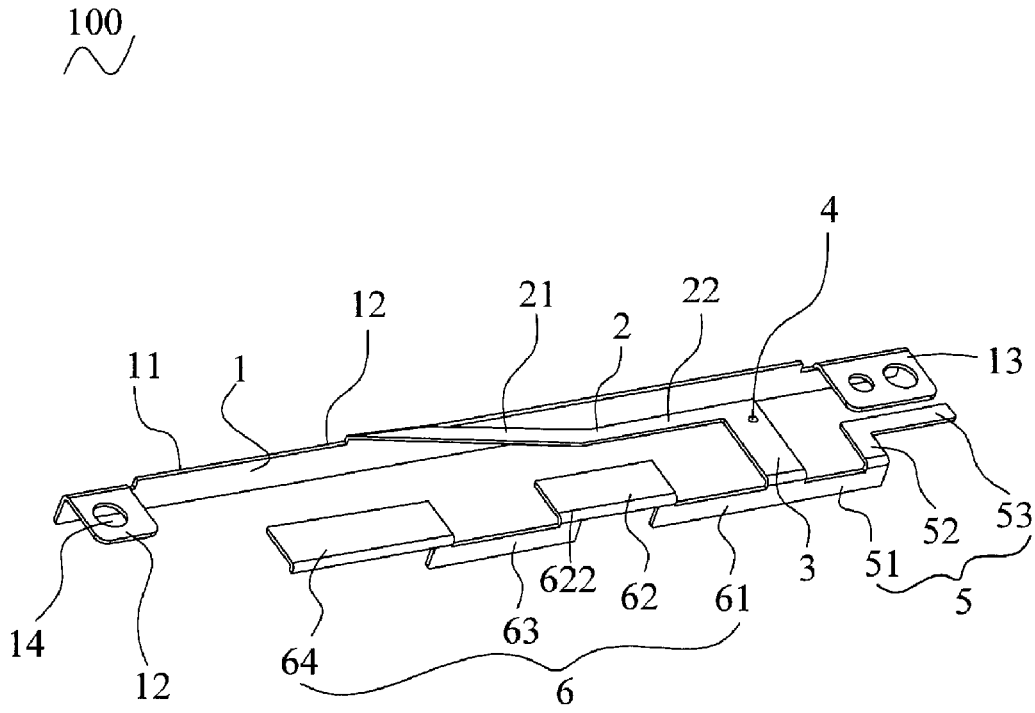
FIG. 2 is a perspective view of the multi-band antenna shown in FIG. 1 seen from anther direction.

Please refer to FIG. 1, an embodiment of a multi-band antenna mounted on a Note Book (not shown) according to the present invention is shown. The multi-band antenna 100 punched from a sheet metal includes an elongated grounding plate 1, a simulation induction portion 2, a connecting portion 3, a feeding point 4, a high frequency radiator 5 and a low frequency radiator 6.

The elongated grounding plate 1 disposed vertically has a top edge 11 defined thereon. Two opposing ends of the top edge 11 respectively extend perpendicularly to the grounding plate 1 to form a first fixing portion 12 and a second fixing portion 13 both of rectangular shape. The first fixing portion 12 and the second fixing portion 13 are punched to form fixing holes 14 thereon for fixing the multi-band antenna 100 on the Note Book (not shown). The simulation induction portion 2 mitered with the grounding plate 1 has a first conduction strip 21 extended obliquely from a substantial middle of the top edge 11 and located at a substantially same plane with the first fixing portion 12, a second conduction strip 22 extended along the top edge 11 and towards the second fixing portion 13 from a free end of the first conduction strip 21 to form an obtuse angle between the first and second conduction strips 21, 22. A plane in which the grounding plate 1 locates is perpendicular to a plane in which the simulation induction portion 2 locates. A free end of the second conduction strip 22 extends opposite to the grounding plate 1 and perpendicularly to form a connecting portion 3. The feeding point 4 is disposed on the connecting portion 3, adjacent to the second conduction strip 22. The high frequency radiator 5 has a first radiation strip 51 extended downwards and then elongated towards the second fixing portion 13 from a free end of the connecting portion 3, parallel and facing to the grounding plate 1. A top edge of a free end of the first radiation strip 51 extends towards the grounding plate 1 to form a second radiation strip 52. A third radiation strip 53 extends perpendicularly from a free end of the second radiation strip 52 and opposite to the first radiation strip 51. The third radiation strip 53 is spaced and flush with the second fixing portion 13 with a predetermined distance. The low frequency radiator 6 defines a fourth radiation strip 61 extended opposite to the first radiation strip 51 from an end of the first radiation strip 51 away from the second radiation strip 52. A fifth radiation strip 62 is located at a substantially same plane with the connecting portion 3, with an inner edge 621 spaced from the second conduction strip 22 and an outer edge 622 farther from the grounding plate 1 than the inner edge 621 thereof. Two opposite ends of the outer edge 622 of the fifth radiation strip 62 respectively are connected with a free end of the fourth radiation strip 61 and an end of a sixth radiation strip 63. The sixth radiation strip 63 extends from the fifth radiation strip 62 opposite to and in alignment with the fourth radiation strip 61. A seventh radiation strip 64 extends from a free end of the sixth radiation strip 63 opposite to and in alignment with the fifth radiation strip 62.

When the multi-band antenna operates at a wireless communication environment, the simulation induction portion 2 achieves impedance matching with the low frequency radiator 5 and the high frequency radiator 6. A current is fed from the feeding point 4 to the low frequency radiator 5 to generate an electronic resonance corresponding to frequency band ranging between 824 MHz and 960 MHz. While the current is fed from the feeding point 4 to the high frequency radiator 6 to generate an electronic corresponding to frequency band ranging between 1710 MHz and 2170 MHz.

Figure 3:
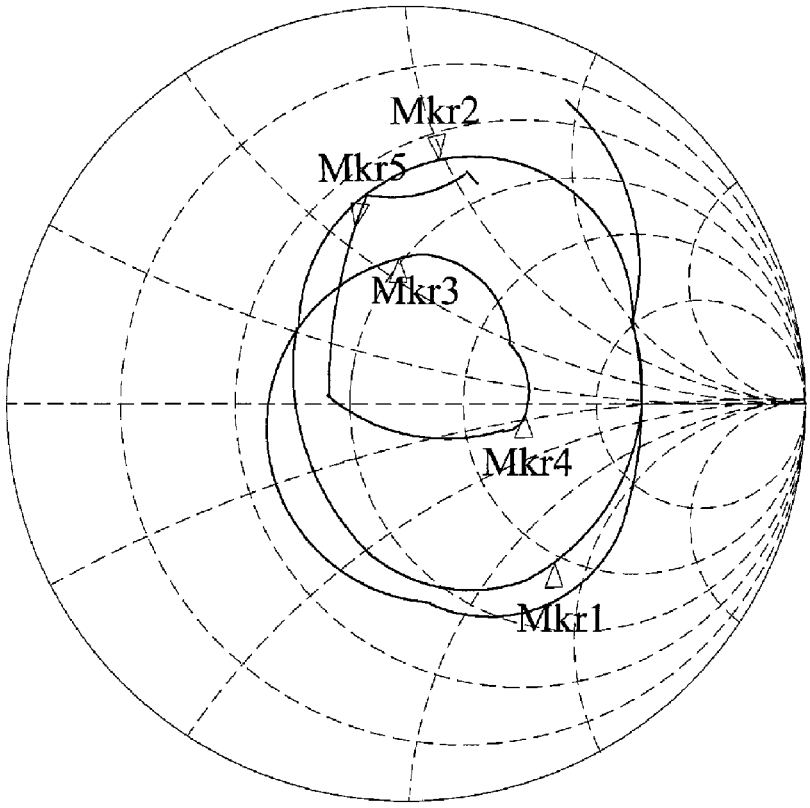
FIG. 3 shows is a Smith chart recording impedance of the multi-band antenna shown in FIG. 1.

Please refer to FIG. 3, which shows a Smith chart recording the impedance of the multi-band antenna in the embodiment when the multi-band antenna operates at a wireless communication environment. The multi-band antenna exhibits an impedance of (92.295−j75.890) Ohm at 824 MHz, an impedance of (36.661+j47.554) Ohm at 960 MHz, an impedance of (49.336+j27.195) Ohm at 1.71 GHz, an impedance of (88.579−j6.602) Ohm at 1.88 GHz, an impedance of (38.577+j26.485) Ohm at 2.17 GHz. Therefore, the multi-band antenna has good impedance characteristics.

Figure 4:
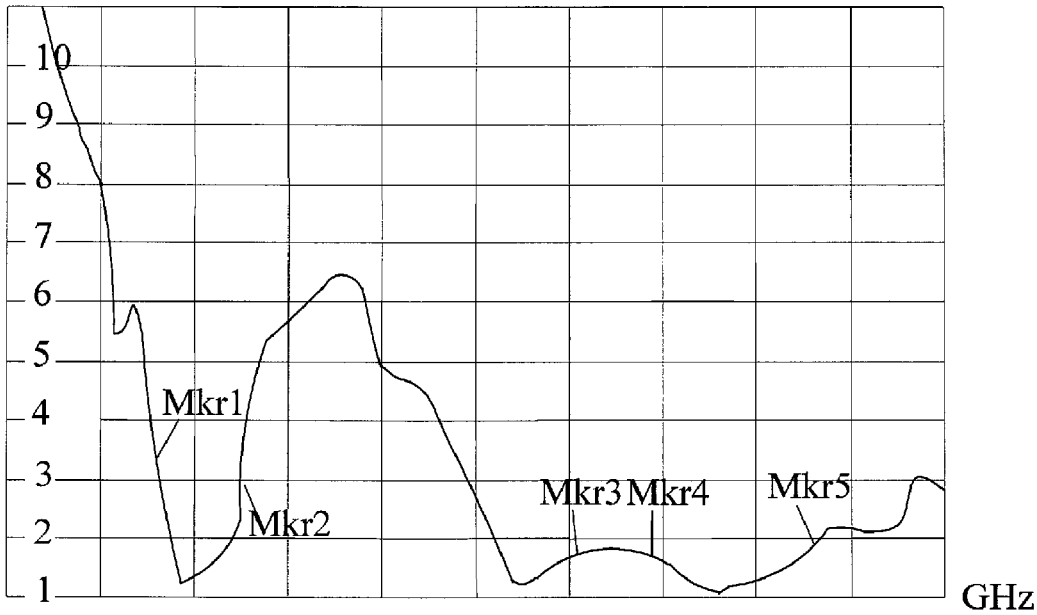
FIG. 4 shows a Voltage Standing Wave Ratio (VSWR) test chart of the multi-band antenna shown in FIG. 1.

Please refer to FIG. 4, which shows a Voltage Standing Wave Ratio (VSWR) test chart of the multi-band antenna in the embodiment when the multi-band antenna operates at a wireless communication environment. When the multi-band antenna operates at 824 MHz (indicator Mkr1 in FIG. 4), the VSWR value is 3.338. When the multi-band antenna operates at 960 MHz (indicator Mkr2 in FIG. 4), the VSWR value is 2.922. When the multi-band antenna operates at 1.71 GHz (indicator Mkr3 in FIG. 4), the VSWR value is 1.708. When the multi-band antenna operates at 1.88 GHz (indicator Mkr4 in FIG. 4), the VSWR value is 1.768. When the multi-band antenna operates at 2.17 GHz (indicator Mkr5 in FIG. 4), the VSWR value is 1.912. The VSWR value of the multi-band antenna shows that the multi-band antenna has an excellent frequency response between 824 MHz~960 MHz and between 1.71 GHz~2.17 GHz.

Please refer to FIG. 5, which shows a chart of an antenna transmission ratio of the multi-band antenna in the embodiment. When the multi-band antenna receives and sends electromagnetic signals in GSM 850 (824~880 MHZ), the average antenna transmission ratio is 57.97%. When the multi-band antenna receives and sends electromagnetic signals in GSM 900 (881~960 MHZ), the average antenna transmission ratio is 70.71%. When the multi-band antenna receives and sends electromagnetic signals in DCS (1710~1850 MHZ), the average antenna transmission ratio is 58.50%. When the multi-band antenna receives and sends electromagnetic signals in PCS (1880~1990 MHZ), the average antenna transmission ratio is 67.38%. When the multi-band antenna receives and sends electromagnetic signals in WCDMA (2110~2170 MHZ), the average antenna transmission ratio is 44.91%. The average antenna transmission ratio shows that the multi-band antenna has a good performance in low and high bands.

As described above, the multi-band antenna 100 has a simple and compact structure to suit miniaturization development of the portable electronic device and reduce a manufacture cost, meanwhile, can improve performances of the multi-band antenna 100 in a high and low frequency bands, such as in GSM850 (824~880 MHZ), GSM900 (881~960 MHZ), DCS (1710~1850 MHZ), PCS (1880~1990 MHZ) and WCDMA (2110~2170 MHZ).

Furthermore, the present invention is not limited to the embodiment described above; various additions, alterations and the like may be made within the scope of the present invention by a person skilled in the art. For example, respective embodiments may be appropriately combined.

What is claimed is:

1. A multi-band antenna, comprising:

an elongated grounding plate disposed vertically with a top edge defined thereon, two opposing ends of the top edge respectively extending perpendicularly to form a first fixing portion and a second fixing portion;

a simulation induction portion including a first conduction strip extended obliquely from a substantial middle of the top edge and located at a substantially same plane with the first fixing portion, a second conduction strip extended along the top edge and towards the second fixing portion from a free end of the first conduction strip to form an obtuse angle between the first and second conduction strips;

a connecting portion extended opposite to the grounding plate and perpendicularly from a free end of the second conduction strip;

a feeding point disposed on the connecting portion, adjacent to the second conduction strip;

a high frequency radiator, the high frequency radiator having a first radiation strip extended downwards and then elongated towards the second fixing portion from a free end of the connecting portion, facing to the grounding plate, a second radiation strip extended towards the grounding plate from a top edge of a free end of the first radiation strip, a third radiation strip extended perpendicularly from a free end of the second radiation strip and opposite to the first radiation strip; and a low frequency radiator, the low frequency radiator including a fourth radiation strip extended oppositely to the first radiation strip from an end of the first radiation strip away from the second radiation strip, a fifth radiation strip located at a substantially same plane with the connecting portion, with an inner edge and an outer edge farther from the grounding plate than the inner edge thereof, two opposite ends of the outer edge of the fifth radiation strip respectively connecting with a free end of the fourth radiation strip and an end of a sixth radiation strip, the sixth radiation strip extending from the fifth radiation strip opposite to and in alignment with the fourth radiation strip, and a seventh radiation strip extending from a free end of the sixth radiation strip opposite to and in alignment with the fifth radiation strip.

2. The multi-band antenna as claimed in claim 1, wherein the first fixing portion and the second fixing portion have fixing holes for fixing the multi-band antenna to a portable electronic device.

3. The multi-band antenna as claimed in claim 1, wherein the third radiation strip is spaced and flush with the second fixing portion with a predetermined distance.

4. The multi-band antenna as claimed in claim 1, wherein the inner edge of the fifth radiation strip is spaced from the second conduction strip of the simulation induction portion with a predetermined distance.

* * * * *